US009815213B2

(12) United States Patent
Duey

(10) Patent No.: US 9,815,213 B2
(45) Date of Patent: Nov. 14, 2017

(54) KNIFE WITH AMBIDEXTROUS ACTUATORS AND LOCKING MECHANISM

(71) Applicant: BENCHMADE KNIFE CO., INC., Oregon City, OR (US)

(72) Inventor: Wes Duey, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 150 days.

(21) Appl. No.: 14/759,214

(22) PCT Filed: Feb. 22, 2014

(86) PCT No.: PCT/US2014/017856
§ 371 (c)(1),
(2) Date: Jul. 3, 2015

(87) PCT Pub. No.: WO2014/130905
PCT Pub. Date: Aug. 28, 2014

(65) Prior Publication Data

US 2015/0352730 A1 Dec. 10, 2015

Related U.S. Application Data

(60) Provisional application No. 61/768,606, filed on Feb. 25, 2013.

(51) Int. Cl.
*B26B 1/04* (2006.01)

(52) U.S. Cl.
CPC ..... *B26B 1/048* (2013.01); *B26B 1/046* (2013.01)

(58) Field of Classification Search
CPC ..... B26B 1/046; B26B 1/048
(Continued)

(56) References Cited

U.S. PATENT DOCUMENTS 2,741,841 A 4/1956 Egeth
3,834,022 A 9/1974 Students
(Continued)

FOREIGN PATENT DOCUMENTS

FR 0634252 A1 1/1995
FR 2793182 11/2000

OTHER PUBLICATIONS

Extended European Search Report; European Patent Application No. 14754872.1, which is a copending European Application that claims priority from PCT/US2014/017856.

*Primary Examiner* — Hwei C Payer
(74) *Attorney, Agent, or Firm* — Schwabe Williamson & Wyatt, P.C.

(57) ABSTRACT

A folding knife has ambidextrously accessible trigger mechanism for releasing the blade from its open and locked position so that it may be moved to the closed position, and when the knife is fitted with an automatic opening mechanism, for releasing the blade from its closed and locked position to the open and locked position. When the blade reaches the open position a novel locking mechanism securely locks the blade open. The trigger mechanism comprises a button on each side of the knife handle. The user may fire the automatic opening mechanism by depressing either the right or left hand trigger button, or both simultaneously. The release mechanism may be incorporated in an auto-assist or manual knife. The locking mechanisms described herein may be incorporated into a manual opening knife or a knife with an auto-assist opening mechanism and in all cases, the knife incorporates a locking mechanism that locks the blade open in a highly secure manner.

11 Claims, 12 Drawing Sheets

(58) Field of Classification Search
USPC ..... 30/160, 161
See application file for complete search history.

(56) References Cited

U.S. PATENT DOCUMENTS

| | | | | |
|---|---|---|---|---|
| 4,974,323 | A | 12/1990 | Cassady | |
| 5,029,354 | A | 7/1991 | Boyd, Jr. et al. | |
| 5,044,079 | A | 9/1991 | Gibbs | |
| 5,647,129 | A | 7/1997 | Stamper | |
| 5,819,414 | A | 10/1998 | Marifone | |
| 5,822,866 | A * | 10/1998 | Pardue | B26B 1/048 30/160 |
| 5,915,792 | A | 6/1999 | Sakurai | |
| 5,964,035 | A | 10/1999 | Poehlmann | |
| 6,308,420 | B1 | 10/2001 | Moser | |
| 6,363,615 | B1 | 4/2002 | Moser | |
| 6,574,869 | B1 | 6/2003 | McHenry et al. | |
| 6,618,946 | B2 | 9/2003 | Seraphin | |
| 6,651,344 | B2 | 11/2003 | Cheng | |
| 6,675,484 | B2 | 1/2004 | McHenry et al. | |
| 6,732,436 | B2 | 5/2004 | Moizis | |
| 6,941,661 | B2 | 9/2005 | Frazer | |
| 6,951,055 | B1 | 10/2005 | Collins | |
| 7,086,157 | B2 | 8/2006 | Vallotton | |
| 7,107,686 | B2 | 9/2006 | Linn et al. | |
| 7,243,430 | B1 | 7/2007 | Lerch | |
| 7,278,213 | B2 | 10/2007 | Perdue et al. | |
| 7,293,360 | B2 | 11/2007 | Steigerwalt et al. | |
| 7,296,355 | B2 | 11/2007 | Onion | |
| 7,313,866 | B2 | 1/2008 | Linn et al. | |
| 7,325,312 | B1 | 2/2008 | Janich | |
| 7,380,340 | B1 | 6/2008 | Lerch | |
| 7,437,822 | B2 | 10/2008 | Flagg et al. | |
| 7,603,778 | B1 | 10/2009 | Lerch | |
| 7,627,951 | B2 | 12/2009 | Glesser | |
| 7,676,931 | B2 | 3/2010 | Knight et al. | |
| RE41,259 | E | 4/2010 | McHenry et al. | |
| 7,698,821 | B2 | 4/2010 | Ralph | |
| 7,748,122 | B2 | 7/2010 | Duey | |
| 7,918,028 | B2 | 4/2011 | Steigerwalt et al. | |
| D639,632 | S | 6/2011 | Freeman et al. | |
| 8,046,923 | B2 | 11/2011 | Liu | |
| 8,171,645 | B2 | 5/2012 | Duey | |
| 8,375,590 | B2 | 2/2013 | Duey | |
| 8,499,461 | B1 | 8/2013 | Mollick et al. | |
| 8,646,184 | B2 * | 2/2014 | Westerfield | B26B 1/046 30/155 |
| 8,732,958 | B2 * | 5/2014 | Huang | B26B 1/048 30/160 |
| 8,959,779 | B2 * | 2/2015 | Wen | B26B 1/046 30/155 |
| 8,966,769 | B1 * | 3/2015 | Mollick | B26B 1/04 30/161 |
| 9,492,916 | B2 * | 11/2016 | Snyder | B25G 1/08 |
| 2002/0124415 | A1 | 9/2002 | Mizutani et al. | |
| 2003/0140500 | A1 | 7/2003 | Cheng | |
| 2004/0154170 | A1 | 8/2004 | Kain et al. | |
| 2004/0158991 | A1 | 8/2004 | Freeman | |
| 2004/0261272 | A1 | 12/2004 | Moser | |
| 2005/0223562 | A1 | 10/2005 | Pardue et al. | |
| 2006/0059694 | A1 | 3/2006 | Carter | |
| 2006/0064877 | A1 | 3/2006 | Vallotton et al. | |
| 2007/0137047 | A1 | 6/2007 | Kim | |
| 2007/0169354 | A1 | 7/2007 | Ralph | |
| 2007/0180702 | A1 | 8/2007 | Haw et al. | |
| 2008/0201953 | A1 | 8/2008 | Bremer et al. | |
| 2008/0301949 | A1 | 12/2008 | Enga et al. | |
| 2009/0056146 | A1 | 3/2009 | Duey | |
| 2009/0119926 | A1 | 5/2009 | Nenadic | |
| 2009/0265939 | A1 | 10/2009 | Chu | |
| 2009/0277015 | A1 | 11/2009 | Duey | |
| 2009/0288301 | A1 | 11/2009 | Hawk et al. | |
| 2010/0140059 | A1 | 6/2010 | Kagami et al. | |
| 2011/0067247 | A1 | 3/2011 | Huang | |
| 2011/0162211 | A1 | 7/2011 | Maxey | |
| 2011/0167647 | A1 | 7/2011 | Gringer et al. | |
| 2012/0047746 | A1 | 3/2012 | Caswell | |
| 2015/0352730 | A1 * | 12/2015 | Duey | B26B 1/048 30/159 |
| 2016/0136824 | A1 * | 5/2016 | Glesser | B26B 1/048 30/161 |

* cited by examiner

KNIFE WITH AMBIDEXTROUS ACTUATORS AND LOCKING MECHANISM

TECHNICAL FIELD

The present invention relates to knives, and more particularly, to a knife that features an opening mechanism that has trigger buttons on both sides of the handle so that the knife may be fired with either the user's left hand or right hand. A knife according to the invention that incorporates the "ambidextrous" mechanism described herein may be an automatic opening knife, an auto assisted-opening type of knife or a manual-open knife. The knife further comprises a novel locking mechanism that locks the blade in the open position and which is defined by a lock having greatly improved functionality over prior locks. The locking mechanism is capable of being incorporated into the knife shown herein any type of opening mechanism, whether automatic, auto-assist or manual.

BACKGROUND INFORMATION

Folding knives are invaluable tools that are used in many aspects of everyday life, and there are many, many types and styles of folding knives. An automatic knife is generally defined as a folding knife that includes some type of mechanism that automatically drives the blade from a closed position to an open position when the user manipulates some kind of trigger. Automatic folding knifes are nearly as ubiquitous as manual folding knives. As noted, these knives include some type of a mechanism—almost always a spring-driven mechanism—that drives the blade from the dosed position to the open position when the user activates the automatic mechanism, typically by pushing a button or analogous activating mechanism —"trigger." Generally speaking, in a knife that has an automatic opening mechanism the blade is held in the closed position by a latched trigger mechanism. When closed, the blade is under a constant "pre-load" pressure from a spring mechanism. When the trigger is released, the blade is automatically driven by the spring mechanism into the open position.

On the other hand, a "manual" folding knife is a very traditional type of tool in which the blade is manually movable by the user between a closed or stowed position in which the sharp edge of the blade is held safely within the handle, and an open position in which the blade is extended in an operable position. There are innumerable variations on this basic theme.

Another popular style of folding knife is one that incorporates an auto-assist opening feature. There are many kinds of so-called auto assist knives and many mechanisms used in them. Generally described, in an auto assist knife the user manually rotates the blade from its fully dosed position toward the open position. When the blade reaches a threshold point in the rotation, a spring mechanism is activated and from that point automatically drives the blade to the fully open position. As with manual and automatic knives, most auto assist knives include locks that secure the blade in the open position.

Most folding knives, whether manual, auto assist or automatic, incorporate some kind of a mechanism that holds the blade or working implement in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety. As noted, many folders also include mechanisms that lock the blade in the open position, primarily as a safety feature. There are many different types of these locks.

Automatic knives have many uses and can be used in many different settings. One primary use for automatic knives is in the fields of law enforcement and military operations. Personnel in these fields often need to have the knife ready for use very quickly and the automatic opening mechanism thus facilitates their jobs. However, a drawback to most known automatic knives is that the trigger mechanism is typically "handed"—that is, the trigger is designed for operation by either the right or left hand and, typically, most triggers are designed for right-handed users. For example, many automatic knives place the trigger so that it is located in the "left" side handle of the knife. The trigger is manipulated by the user's thumb. Clearly, such a configuration is designed for a right-handed user. While the mechanism may be reversed for a left-handed user, it cannot easily be activated ambidextrously.

In practice, often times during their normal daily routines, law enforcement officers and military personnel will have one hand occupied with one job and need to be able to access a knife with the other hand. Take the example of a right-handed military user. If such a user has their right hand occupied—say holding onto a rope while descending from a helicopter—and their knife of choice is an automatic opening knife, then that user need to be able to open his or her knife with their left hand. If the automatic knife is a "right-handed" opener, then the user will find it very difficult to open the blade. This could cause delays and danger to the personnel.

The same applies to manual and auto assist knives that are designed to be opened with one hand or the other, but not both.

There is a need therefore for knives that incorporate trigger or other opening mechanisms that are truly ambidextrous so that the blade may be opened with equal ease by both right and left-handed users.

As noted previously, most knives incorporate locking mechanisms that lock the blade securely in the open position. The need for such locks is obvious: they prevent unintentional closing of the blade during use, which would be very dangerous. There are many, many different types of locking mechanisms available, from the ubiquitous "liner locks" to top locks to the lock described in U.S. Reissue Pat. No. RE 41259, which is assigned to the assignee of the present invention and the disclosure of which is incorporated herein by this reference. Despite the availability of many different types of blade locks, there is a need for strong and functional locking mechanisms for folding knives.

The present invention comprises a folding knife incorporating an ambidextrously accessible trigger mechanism for opening the blade from is dosed and locked position into the open position. The ambidextrous mechanism may be incorporated into any type of knife: automatic, auto assist and manual. Regardless of the style of opening, when the blade according to the invention reaches the open position the novel locking mechanism described herein securely locks the blade open. The ambidextrous trigger mechanism comprises a button accessible to the user on each side of the knife handle. Taking the example of the mechanism in an automatic opening knife, the user may fire the automatic opening mechanism by depressing either the right or left hand trigger button, or both simultaneously. The locking mechanisms described herein automatically lock the blade in the open position. The lock is unlocked in order to fold the blade from open to closed by once again pushing one or both of the ambidextrous buttons.

In other embodiments, ambidextrous the locking mechanisms described herein are incorporated in auto assist and manual knifes that include the locking mechanism described and shown in the drawings.

BRIEF DESCRIPTION OF THE DRAWINGS

The invention will be better understood and its numerous objects and advantages will be apparent by reference to the following detailed description of the invention when taken in conjunction with the following drawings.

FIG. 6A is a perspective view of the lock stud.

FIG. 6B is a side elevation view of the lock stud.

FIG. 6C is a sectional view of the lock stud taken along the line 6C-6C of FIG. 6B.

In FIG. 7, the blade is in the closed and locked position.

In FIG. 9 the blade is in the open and locked position.

FIG. 11A illustrates the blade in the open and locked position with both of the ambidextrous actuator buttons in their resting or home positions.

FIG. 11B shows one of the two actuator buttons being actuated—that is, being pushed inwardly into the handle to release the lock.

FIG. 11C illustrates both of the trigger buttons being actuated simultaneously.

FIG. 14 is a side elevation view of a knife according to the present invention that includes either a manual opening blade, or an auto assist opening mechanism.

FIG. 15 is a side elevation view of the knife shown in FIG. 14, illustrating the opposite side of the knife.

FIG. 16 is a bottom elevation view of the knife of FIG. 14.

FIG. 17A is a perspective view of an alternative embodiment of a lock stud used herein.

FIG. 17B is a front elevation view of the lock stud shown in FIG. 17A.

FIG. 17C is a cross sectional view of the lock stud shown in FIG. 17 taken along the line 17C-17C of FIG. 17B.

FIG. 17D is a top view of the lock stud shown in FIG. 17B.

DETAILED DESCRIPTION OF ILLUSTRATED EMBODIMENTS

A first illustrated embodiment of a folding knife 10 incorporating an ambidextrously actuated automatic opening mechanism and a locking mechanism according to the present invention is illustrated in FIGS. 1 through 12. Generally, folding knife 10 includes an elongate handle 12, and a blade 14 that is pivotally attached to the handle at one of its ends—referred to herein as the "forward" end of the handle. Other relative directional terms correspond to this convention: the "rear" or butt end of the handle is opposite the forward end; the upper part of the blade is the dull, non-working portion and the "lower" part of the blade is the sharpened, working portion; "inner" or "inward" refers to the structural center of the knife, and so on.

Figures 1, 2:
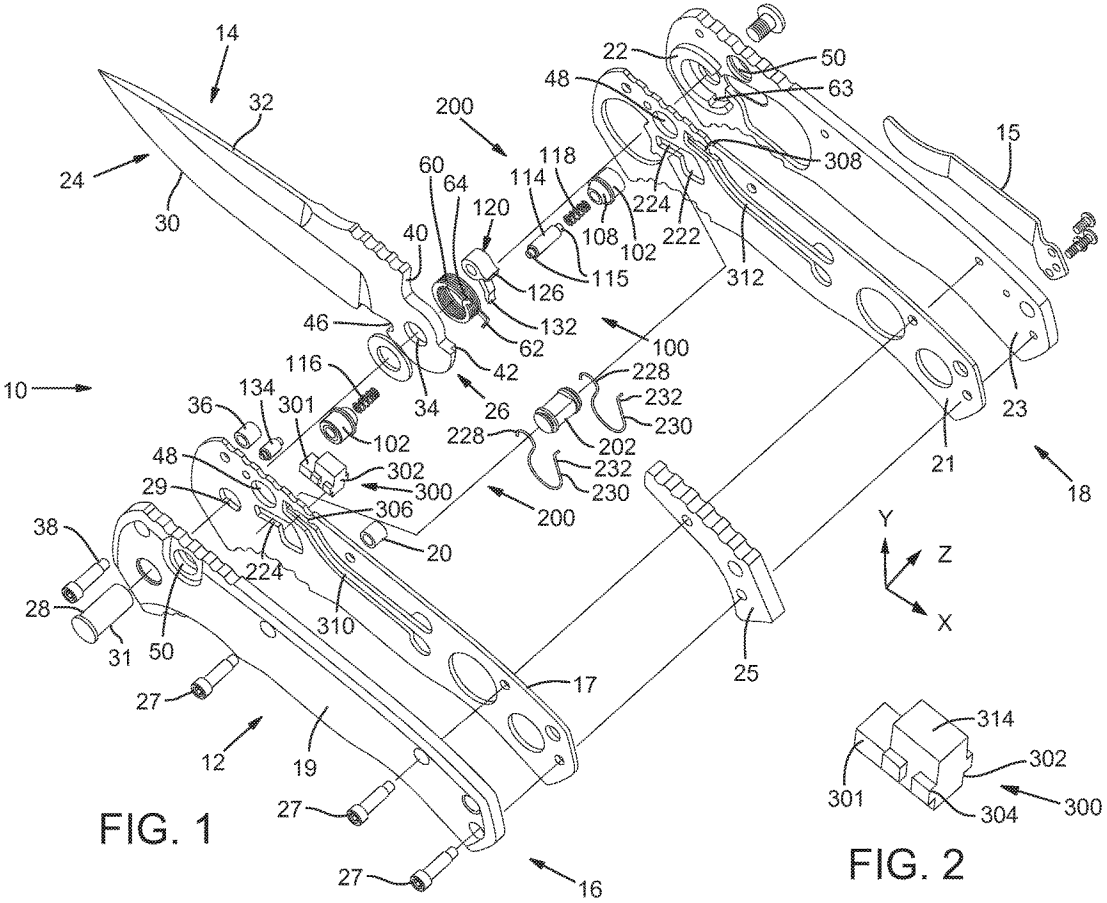
FIG. 1 is an upper perspective and exploded view of a knife according to the present invention that incorporates an ambidextrous trigger in with an automatic opening mechanism.
FIG. 2 is a perspective view of one component of a safety mechanism incorporated in the knife shown in FIG. 1, showing the component in isolation.
Figure 7:
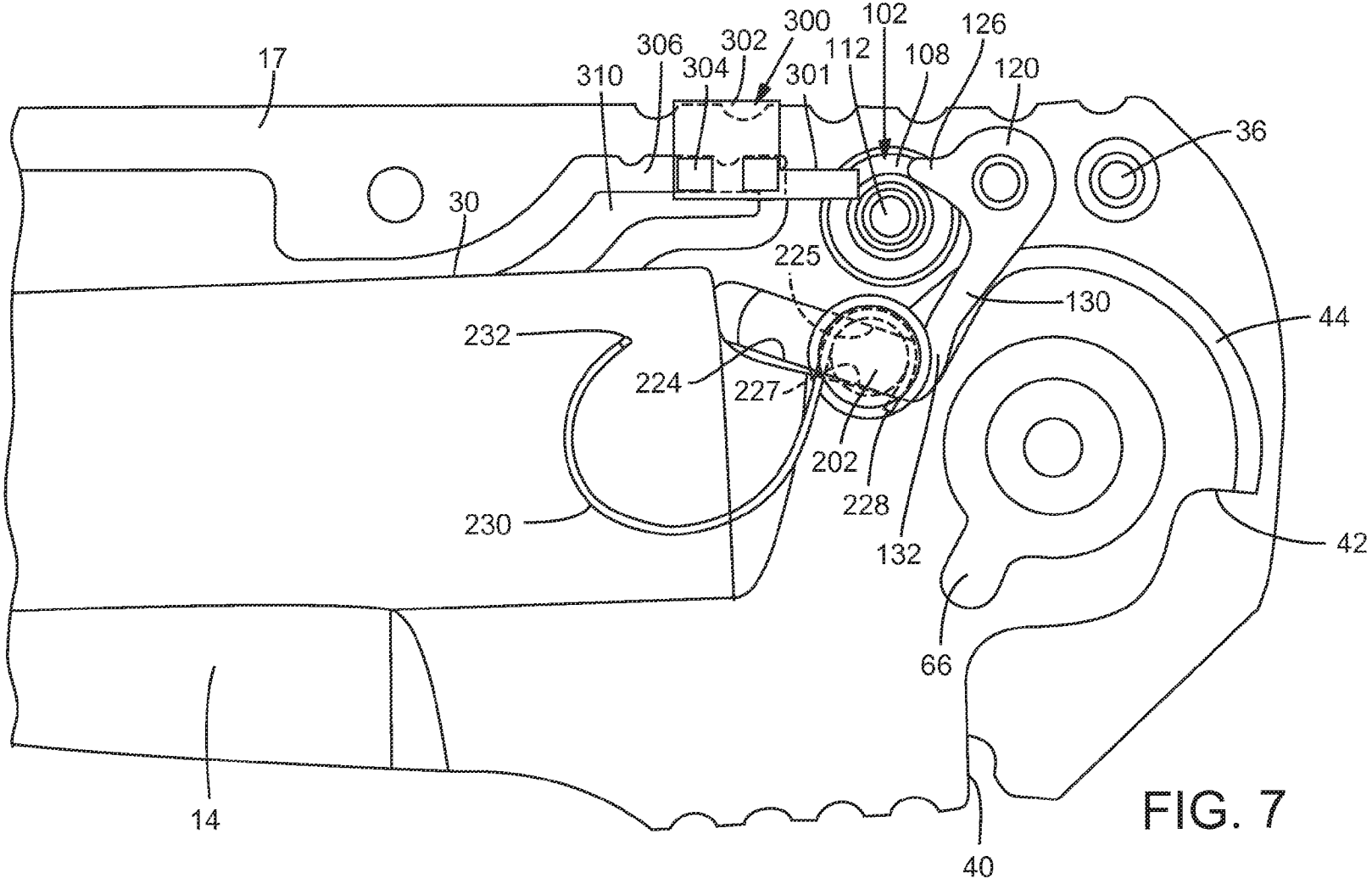
FIG. 7 is a side elevation view of the knife shown in FIG. 1 but in an assembled condition with the near side handle components removed to illustrate select interior components.
Figure 8:
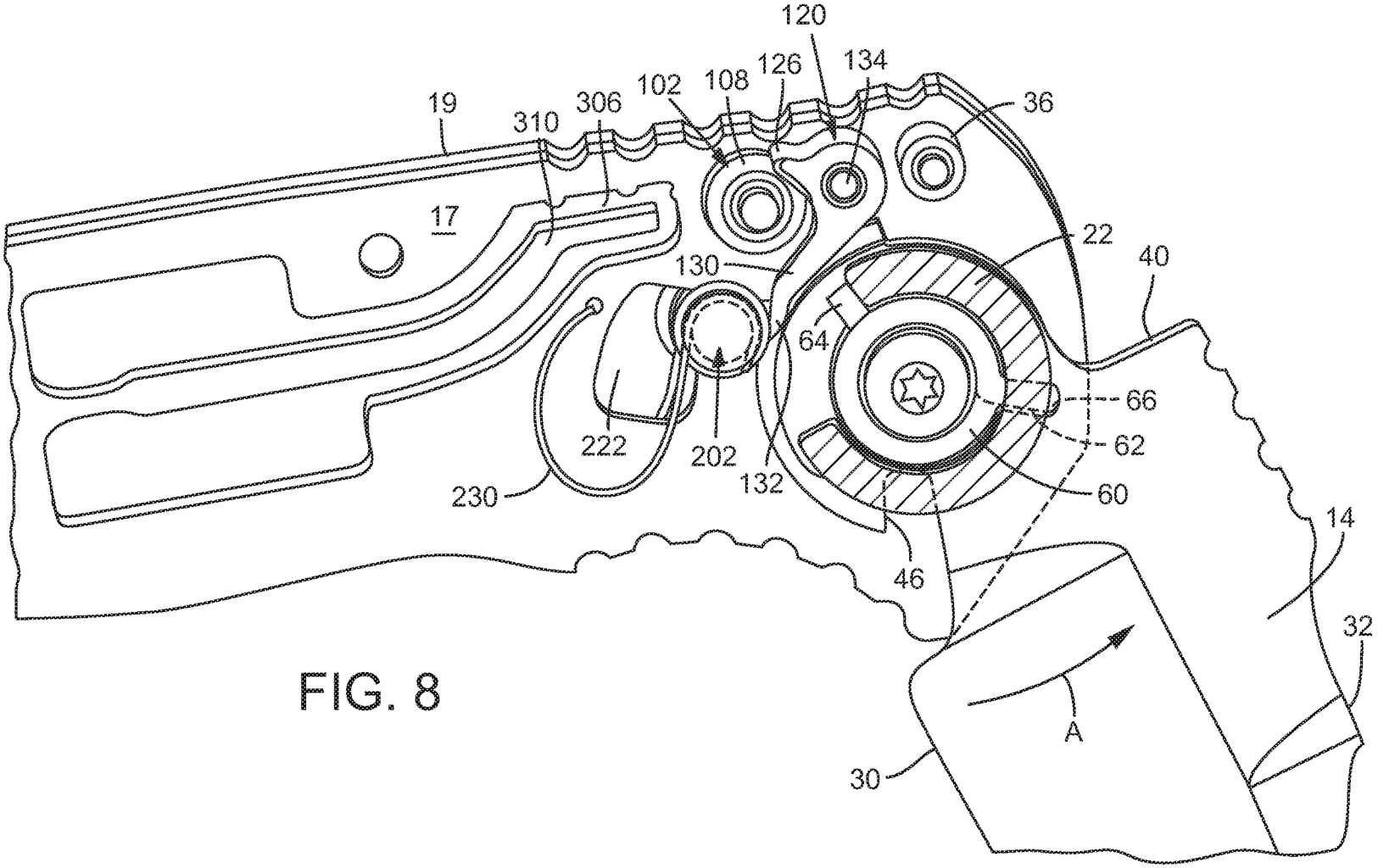
FIG. 8 a side elevation view of the knife shown in FIG. 7 except the automatic opening mechanism has been fired and the blade is in an intermediate position between closed and open as the blade is being automatically driven toward the open position.

Although it shows knife 10 in an exploded view, FIG. 1 shows the knife with the blade 14 in the open position. FIG. 7 illustrates the blade its dosed and locked position with the sharpened edge of the blade safely stowed in the blade-receiving groove defined within the handle between the side walls. FIG. 8 shows the blade midway in its rotation from the dosed to the open position. And in FIG. 9 the blade is shown in the open and locked position in which the blade is in the open locked position. The X-Y plane is defined as the plane parallel to the plane defined by the handle 12 and blade 14. The X direction is parallel to the X ordinate in FIG. 1. The Y is plane coplanar with the X plane and the Y direction is parallel to the Y ordinate, transverse to the X direction—the blade travels in the X-Y plane as it is rotated between the dosed and open positions. The Z plane is the plane transverse to the X-Y and the Z direction is parallel to the Z ordinate; the blade pivot pin extends longitudinally in the Z direction.

It will be readily appreciated that although the automatic ambidextrous actuating mechanisms and locking mechanisms described herein are embodied in a knife, the mechanisms are equally usable in other folding tools in which the knife blade shown herein is replaced by some other type of implement that folds into the handle.

The knife 10 of the present invention incorporates an ambidextrous opening mechanism shown generally at 100.

That mechanism is detailed below, but stated generally, defines a release for releasing a blade locking mechanism. In all cases, the release defined by the ambidextrous opening mechanism is adapted to release the lockup of the blade when it is in the open position and locked. Depending upon the type of opening mechanism that is used in a particular knife (e.g., automatic, semi-automatic or manual), the release may further be used to release the blade from the closed position to move to the open position. The knife 10 further incorporates a blade locking mechanism shown generally at 200 so that blade may be locked securely in the open position to prevent the inadvertent movement of the blade to its closed position, and, when an automatic opener is incorporated in the knife, also to lock the blade in the closed position ready to be fired by the opening mechanism 100. The blade locking mechanism 200 is described below.

Handle 12 of knife 10 comprises several components, including a pair of oppositely located side wall sections, generally indicated at 16, 18, that are parallel with each other and held spaced apart from one another by spacers 20, and for example, a spline 25; only one spacer 20 is shown in FIG. 1. Each of the side wall sections 16 and 18 comprises an inner liner and an outer plate that are held parallel to one another. Specifically, side wall 16 is defined by liner 17 and outer plate 19. Likewise, side wall 18 is defined by liner 21 and outer plate 23. Various screws 27 as shown in FIG. 1 connect the sidewalls together as is known in the art. The screws thus secure the spacers 20 and spline 25 between the liners 17 and 21 of side walls 16 and 18 to maintain the handle 12 in a secure relationship with side walls 16 and 18 held in a spaced apart relationship to define a blade receiving groove between the side walls. Side wall sections 16 and 18 may be fabricated from any suitable material such as a reinforced synthetic plastic; other suitable materials include metal, other plastics, wood, etc. The side wall sections may be fabricated in singled or multiple pieces. As shown in FIG. 1, an optional pocket clip 15 may be included if desired—the clip is attached to the exterior surface of outer plate 23.

The blade 14 is pivotally attached to the handle 12 near the forward end of the handle. Except as specifically described below, the blade used with knife 10 may be of any known type. The blade 14 shown in the drawings comprises an elongate working portion shown generally at 24 and a tang portion, shown generally at 26. The blade 14 is pivotally attached the handle 12 with a blade axis pin, which is detailed below. Working portion 24 typically includes a sharp edge 30 and a blunt edge 32.

A blade receiving groove is defined between the side walls16, 18 by virtue of the spacers and spline, described above. The blade receiving groove defines a slot into which the blade 14 is received when it is moved to its closed position. When the blade is in the closed position, the sharp edge 30 of the blade is held safely within the confines of the handle.

Blade 14 is attached to handle 12 such that the blade's working portion 24 extends away from the handle 12 when the blade 14 is in its open position (FIG. 1), and tang portion 26 is located within the blade receiving groove between the paired handle side walls when the blade is in either the open or the dosed position. That is, the tang portion 26 is always located between the side walls 16 and 18 of handle 12. The blade is pivotally attached to the handle with blade axis pin 28, which extends transverse to the plane of the blade and defines a blade pivot shaft. Blade axis pin 28 is defined by a cylindrical sleeve that extends through aligned bores formed in the outer plates and liners. The sleeve also extends through aligned pivot bore 34 through tang portion 26 of blade 14. In the assembled knife 10, blade axis pin 28 is fitted snugly and fixedly through the pivot bore 34 in tang 26 of blade 14 so that the sleeve defines a rotational pivot axis for the blade extending transversely with respect to the plane of the blade and the side walls. Thus, pin 28 is axially aligned in the Z-direction—transverse to the X-Y plane.

A blade stop pin 36 has its opposite ends anchored to liners 17 and 21 with a screw 38. Blade stop pin 36 stops rotation of blade 14 in the fully open position when a shoulder 40 on the blade makes contact with the stop pin.

When the knife 10 is assembled with the various screws and spacers described above and shown in the drawings, the knife is very stable and there is no appreciable blade "wobble" relative to the handle.

Figure 3:
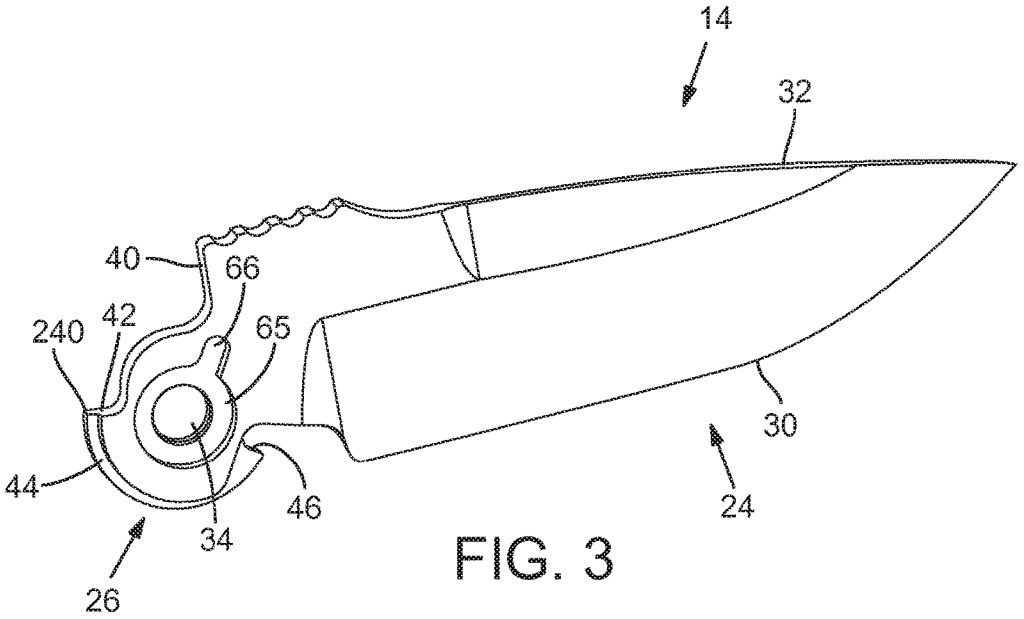
FIG. 3 is a perspective view of one side of the knife blade used in the present invention, shown in isolation.

Select individual components of knife 10 will now be described beginning with blade 14 as shown in isolation in FIG. 3. As noted above, blade 14 is defined by a working portion 24 and a tang portion 26. The working portion has a sharpened edge 30 and a blunt edge 32. The pivot bore 34 extends through the tang portion 26. The tang portion incorporates several structures that are important to operation and functionality of the present invention and are described beginning with the stop shoulder 40 that is defined by a planar face that is oriented at about 90 degrees to the longitudinal axis along the blade. Tracing around tang portion 26 in the counterclockwise direction in FIG. 3, stop shoulder 40 transitions again about 90 degrees and the tang portion then follows a circumferential path to a first locking surface, or an open lock shoulder 42, which defines a ramped surface that is substantially parallel to the longitudinal axis through the blade. As detailed below, the lock stud (also referred to as the locking or lock pin) engages this open lock shoulder when the blade is in the open and locked position. Continuing in the counterclockwise direction in FIG. 3, the tang portion curves around toward the front of the blade in a curved cut-out groove 44. The curved portion of the tang terminates at a notch 46, which as detailed below, defines a second locking surface that the lock stud engages when the blade is in the closed and locked position. A circumferential cut-out portion 65 is formed in tang portion 26 around pivot bore 34 and a groove 66 extends radially from the cut-out portion 65.

Figure 4:
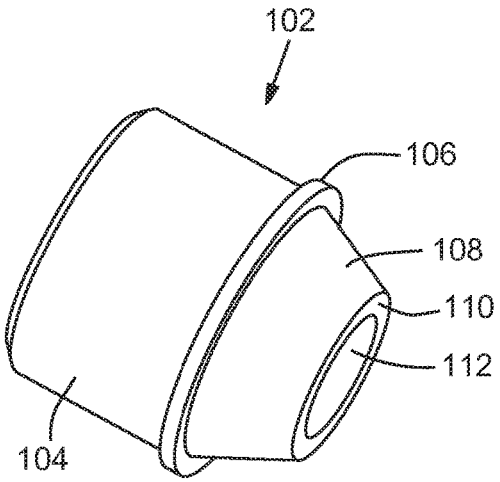
FIG. 4 is a perspective view of one of the trigger or "actuator" buttons used in the knife of the present invention, shown in isolation.

One actuator button 102 of the ambidextrous automatic opening mechanism 100 is shown in isolation in FIG. 4. In the assembled knife 10, the ambidextrous automatic opening mechanism 100 uses two actuator buttons 102—one on each side of the knife and associated with respective sidewalls—but both actuator buttons 102 are identical in structure. Actuator button 102 is defined by a cylindrical portion 104 that in the assembled knife extends through a bore 48 in liner 17 that is aligned with a bore 50 in plate 19 and is thus accessible from the outside of the handle 12. The diameter of bore 48 is greater than the diameter of the cylindrical portion 104 and the diameter of the circumferentially extending lip 106. The diameter of bore 50 is greater than the diameter of portion 104 of the actuator, but very slightly less than the diameter of the lip 106. As such, when the actuator button is inserted through the axially aligned bores 48 and 50, the cylindrical portion 104 extends completely through the bores and is exposed at the outside of the side wall plate 19. The actuator button 102 may be pushed inwardly toward the center of the knife, but cannot be removed from its position in bores 48, 50 because the lip 106 is larger than the bore 50 and the lip thus retains the actuator button 102 in the knife. Immediately adjacent lip 106 is a sloped frustoconical portion 108 that terminates at an interior edge 110. The actuator button 102 has an open but dead-end interior defined by a bore 112.

Figure 5:
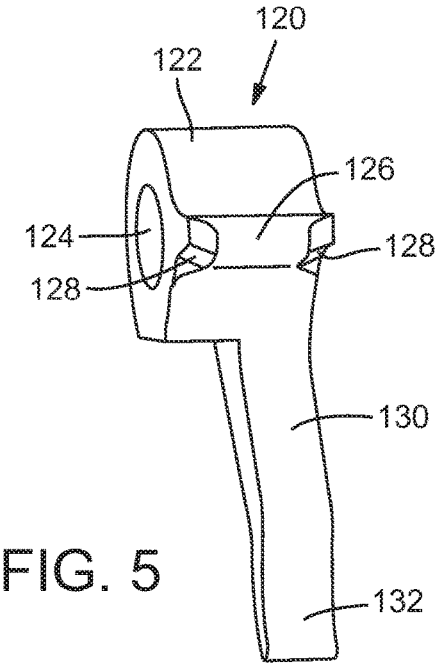
FIG. 5 is a perspective view of the lock stud actuator used in the knife of the present invention, shown in isolation.

Lock stud actuator 120 shown in isolation in FIG. 5 is also a component of the ambidextrous automatic opening mechanism 100. Lock stud actuator interacts with the lock stud 202 and with the actuator buttons 102 as detailed below. With reference to FIG. 5, the lock stud actuator 120 has a cylindrical base 122 with a bore 124 extending therethrough. An outwardly projecting boss 126 extends from cylindrical base 122 and has chamfered, sloping outer edges 128. A tail or lever 130 extends from base 122 and has a curved tip 132 at the terminal end of the lever 130. The width of lever 130 is approximately ½ of the width of the base 122. As detailed below, lever 130 rides in the curved cut-out groove 44 of tang portion 26 of blade 14 during a portion of the rotational path of the blade as it moves from dosed to open, and from open to dosed.

With reference now to the series of figures of 6A, 6B and 6C, the lock stud 202 is show in isolation and in various orientations. An alternative structure for a lock stud is shown in FIGS. 17 and 18 and is described below. Lock stud 202—which also may be referred to as the lock pin or locking pin—is a generally cylindrical body 204 having opposed flattened surfaces 206, 208 and circumferential lips 210, 212 at opposite ends of the cylindrical body 204. The opposed flattened surfaces 206, 208 define parallel planar surfaces, as best shown in the cross sectional view of FIG. 6C. The lock stud 202 is thus an elongate body that defines a cylinder having truncated sides that define the flattened surfaces 206 and 208. Outward of the lips 210 and 212 are circumferential grooves 214 and 216, respectively, which are defined by circumferential lips 218, 220.

Ambidextrous automatic opening mechanism 100 will now be detailed with returning reference to FIG. 1. As will be apparent from the following description, the ambidextrous automatic opening mechanism 100 operates in conjunction and coordination with the locking mechanism 200. The ambidextrous automatic opening mechanism 100 comprises the two actuator buttons 102 which as noted above extend through the aligned bores 48, 50 in the assembled side walls 16 and 18 (i.e., the paired liners and plates 17 and 21, 19 and 23). The buttons 102 are retained in the handle 12 by virtue of the circumferential lips 106 detailed above. A pin 114 has opposite ends with reduced circumference 115 to accept coil springs 116, 118 on the opposite ends. The springs 116 and 118 are inserted into the open and dead end interior bores 112 of respective actuator buttons 102. In the assembled knife 10, each of the actuator buttons 102 is movable independent of the other in a back and forth lateral motion along the Z direction. Normally, the actuator buttons are in a resting or home position defined as the outward most position for the buttons, which are driven to the home positions by springs 116 and 118. But the buttons 102 may be independently depressed to push them inwardly, toward the center of knife 10, by pushing the buttons against the spring force of springs 116, 118.

The lock stud actuator 120 is pivotally attached to the handle with a pin 134 that extends through bore 124 in base 122 and which has its opposite ends fixed into the liners 17 and 19. In the assembled knife 10 the outwardly extending boss 126 is oriented immediately forward of and adjacent to the sloped frustoconical portions 108 of buttons 102 such that when either of the buttons 102 is pushed inwardly (i.e., when the buttons are actuated) the frustoconical portions 108 press on and interact with the chamfered outer edges 128 of boss 126 to thereby cause the firing of the automatic opening mechanism 100, as detailed below.

Figure 11A:
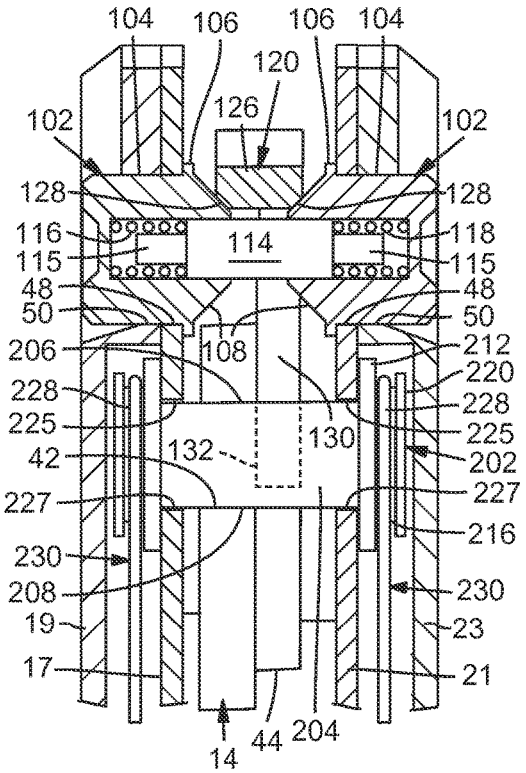
FIGS. 11A, 11B and 11C are a series of partial cross sectional views taken along the line 11-11 of FIG. 9, except in FIG. 11 the knife is fully assembled.

With continuing reference to FIG. 1, lock stud 202 is assembled such that the opposite ends of the lock stud extend through generally L-shaped openings 222 formed in liners 17 and 21, and more specifically, such that the opposite flattened portions 206 and 208 of the lock stud lie closely adjacent and parallel to the opposed flattened sides of the in the elongate opening or slot 224 portions of the openings 222. The opposite ends of the lock stud 202 extend through the respective liners 17 and 21 with circumferential lips 210 and 212 positioned outside of the respective liners (as best shown in the cross sectional views of FIGS. 11A and 11B). The forward end 228 of a U-shaped or horseshoe shaped spring 230 encircles the lock stud on each side of the lock stud in the circumferential grooves 214, 216 that are defined between circumferential lips 210 and 212 and the adjacent circumferential lips 218 and 220. The opposite or rearward ends 232 of the horseshoe shaped springs 230 are fixed to the respective liners. The outer, opposite ends of the lock stud do not extend through the outer plates 19 and 23. Instead, as shown in FIG. 11A, there is a cavity in each outer plate that provides enough clearance between the outer ends of the lock stud and the adjacent inner-facing surfaces of the outer plates that the lock stud is free to move back and forth in slots 224 in the liners between the forward, lock up position and the rearward, release position. It will be further be appreciated, therefore, that the locking mechanism 200 is an internal mechanism that is not directly operated by the user. The locking mechanism is instead operated by actuation of the actuator buttons of the actuating mechanism 100, as detailed below.

In the assembled knife the horseshoe shaped springs 230 are under constant load and therefore are constantly driving the lock stud 202 in the forward direction, toward the tip of blade 14. Nonetheless, the lock stud 202 may be slid in the opposite direction, toward the butt end of the knife against the spring force of springs 230. As the lock stud thus reciprocates along the Y axis the lock stud slides in the elongate slots 224 in liners 17 and 21 with the flattened or truncated portions 206 and 208 aligned with the opposite sides 225 and 227 of the slots 224. The lock stud is unable to axially rotate relative to the liners because the close proximity of the opposite flattened portions 206 and 208 of the lock stud with the flattened sides the interior of the slots 224.

The knife 10 includes a torsion spring 60 that drives the blade automatically from dosed to open. Torsion spring 60 encircles axis pin 28 and has one end 62 fixed relative to plate 23 at a notch 63 (FIGS. 1 and 12) and the opposite end 64 defining a leg that is received in the notch 66 formed in blade 14 and extending radially from the axis through bore 34. The torsion spring 60 is under constant load so that the spring is exerting rotational force on the blade at all times in the closed to open direction, regardless of whether the blade is closed and locked or open and locked.

Finally, a safety mechanism 300 is incorporated into a knife 10 that utilizes an automatic opening mechanism to prevent unintentional firing of the knife. Safety mechanism 300 is defined by a safety bar 302 that has opposed and laterally extending bosses 304 that ride in slots 306, 308 in liners 17 and 21, respectively; the slots 306 and 308 define spring arms 310 and 312. The spring arms are biased to urge the safety bar 302 upwardly (in the direction of the X axis) and the upper portion 314 of the safety bar is accessible at the top of the handle 12. The safety bar 302 includes a forward-extending boss 301 that projects toward the components of the actuating mechanism 100. As detailed below, the safety bar prevents automatic firing of the automatic actuation mechanism 100 by mechanical interference with the actuator buttons 102 such that the buttons cannot be pushed.

Operation of the knife 10 and its various mechanisms will be detailed with reference to various figures, and especially with reference to FIGS. 7, 8 and 9. In FIG. 7 the near side wall (i.e., liner 21 and plate 23) has been removed so that the internal components are better illustrated. The blade 14 is in the closed position and the actuator button 102 is in the home position—that is, the springs116 and 118 are pushing the buttons 102 outwardly to their stop position. The lock stud 202 is in its forward most position under the force of horseshoe shaped spring 230 and is engaging the blade 14 at the notch 46 to thereby retain the blade in the closed position. As noted above, the blade 14 is under constant load that is applied by the torsion spring 60 (not shown in FIG. 7), which is exerting force on the blade in the counterclockwise direction of FIG. 7. However, the blade 14 is locked in this closed position because lock stud 202 is engaged with blade 14 in notch 46 of the blade, which defines the closed locking shoulder. The lock stud thus prevents the blade from moving from the closed position even though there is a constant spring force applied to the blade trying to move it from closed to open.

In FIG. 7 the safety bar 302 is slid into its forward position in which the safety bar prevents automatic firing of the automatic actuation mechanism 100 by mechanical interference with the actuator buttons 102 such that the buttons cannot be pushed. Specifically, when safety bar 302 is in the forward position, the forward-projecting boss 301 is situated immediately adjacent to the sloped frustoconical portion 108 of button 102. The button 102 cannot be pressed inwardly—cannot be moved from its home position, because boss 301 mechanically blocks movement of the button. The boss 301 likewise blocks movement of the actuator button 102 that is on the near side of the knife in FIG. 7, but which is not shown in the figure.

Although not shown in the drawings, another feature that may be added to the safety bar 302 is a tab that extends downwardly from the forward boss 301 and such that when the safety bar 302 is in the forward, safety on position, the downwardly extending tab prevents moving the lock stud 202 out if its lockup position. In other words, when the blade is in the open and locked position, the safety bar 302 is moved forward into the safety on position, and the downwardly extending tab thus prevents the blade from being unlocked until the safety bar is moved to the safety off (rearward) position. This is yet another safety feature that can prevent unintended closing of the blade.

In this closed and locked position, the lock stud actuator 120 has the curved tip 132 of its lever 130 positioned immediately adjacent to and forward of lock stud 202 such that the lock stud 202 is nominally spaced from the curved tip 132 (the horseshoe shaped spring 230 urges the lock stud 202 forward but the lock stud's travel in the elongate slot 224 stops immediately before the lock stud makes contact with the curved tip 132). The outwardly and rearwardly projecting boss 126 of lock stud actuator is positioned immediately adjacent to the sloped frustoconical portion 108 of button 102, opposite of boss 301 when the safety bar is in the forward position.

Moving now to FIG. 8, in which the safety mechanism 300 is not illustrated, the actuating mechanism has been fired and the blade 14 is rotating rapidly in the counterclockwise direction under the force of torsion spring 60, as shown with arrow A. To fire the actuating mechanism, either one of the two actuator buttons 102 is depressed and pushed inwardly into the handle, against the spring force of springs 116, 118. For purposes of illustration and as shown in FIG. 8, button 102 has been pushed inwardly against the force of spring 116 (which is not visible in the figure). As the button 102 is moved from its home position the sloped side of the frustoconical portion 108 of the button pushes on and slides across the chamfered edge 128 of boss 126 of the lock stud actuator 120. As the button 102 is pushed inwardly into the handle and the sloped surface of the frustoconical portion 108 thus pushes on the cooperatively sloped surface of the boss 126, the button causes the lock stud actuator 120 to rotate in the clockwise direction (in FIG. 8) about pin 134, which defines a pivot axis for the lock stud actuator 120. As the lock stud actuator so-rotates, the curved tip 132 pushes the lock stud 202 rearwardly in the elongate slot 224 in liner 17, against the opposite urging force of horseshoe shaped spring 230. As the lock stud 202 moves rearwardly, the lock stud moves out of notch 46 in blade 14. Once the lock stud clears the notch 46, the blade is free to rotate from closed to open under the spring force of torsion spring 60. Inwardly directed pressure applied to button 102 may be released as soon as the lock stud 202 clears notch 46. As the blade rotates rapidly from dosed to open, the tip 132 of lever 130 rides in cut out groove 44 in the tang portion 26 of blade 14.

Blade 14 continues its counterclockwise rotation in FIG. 8 until the shoulder 40 of blade 14 hits blade stop pin 36, at which point the blade rotation rapidly ceases. At this point, assuming that both buttons 102 are in their home positions, lock stud 202 moves rapidly forward under the force of horseshoe shaped spring 230 and into the open locked position. Specifically, with reference to FIG. 9, which shows the blade 14 in the open locked position, lock stud 202 has moved forward onto locking shoulder 42 on the tang portion 26 of blade 14. In this open and locked position the locking stud defines an extraordinarily strong lock up position, as detailed below. As noted, even in this blade-open position the torsion spring 60 is continuously applying spring force to the blade, constantly pushing the blade in the open rotational direction.

Figure 9:
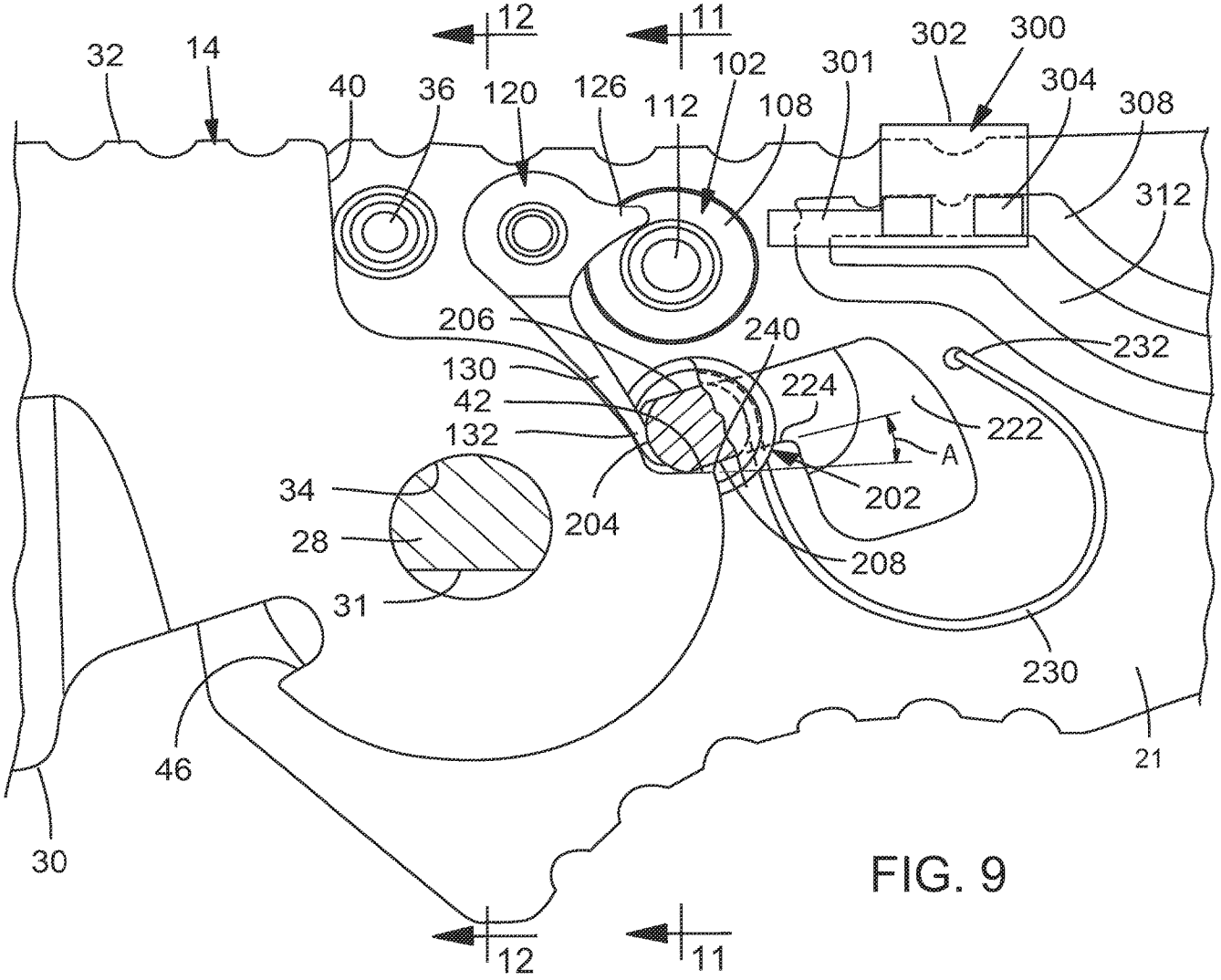
FIG. 9 is a side elevation view of the knife shown in FIGS. 7 and 8, taken from the opposite side of the knife relative to those figures and in which the near side handle has been removed to illustrate select interior components.
Figure 10:
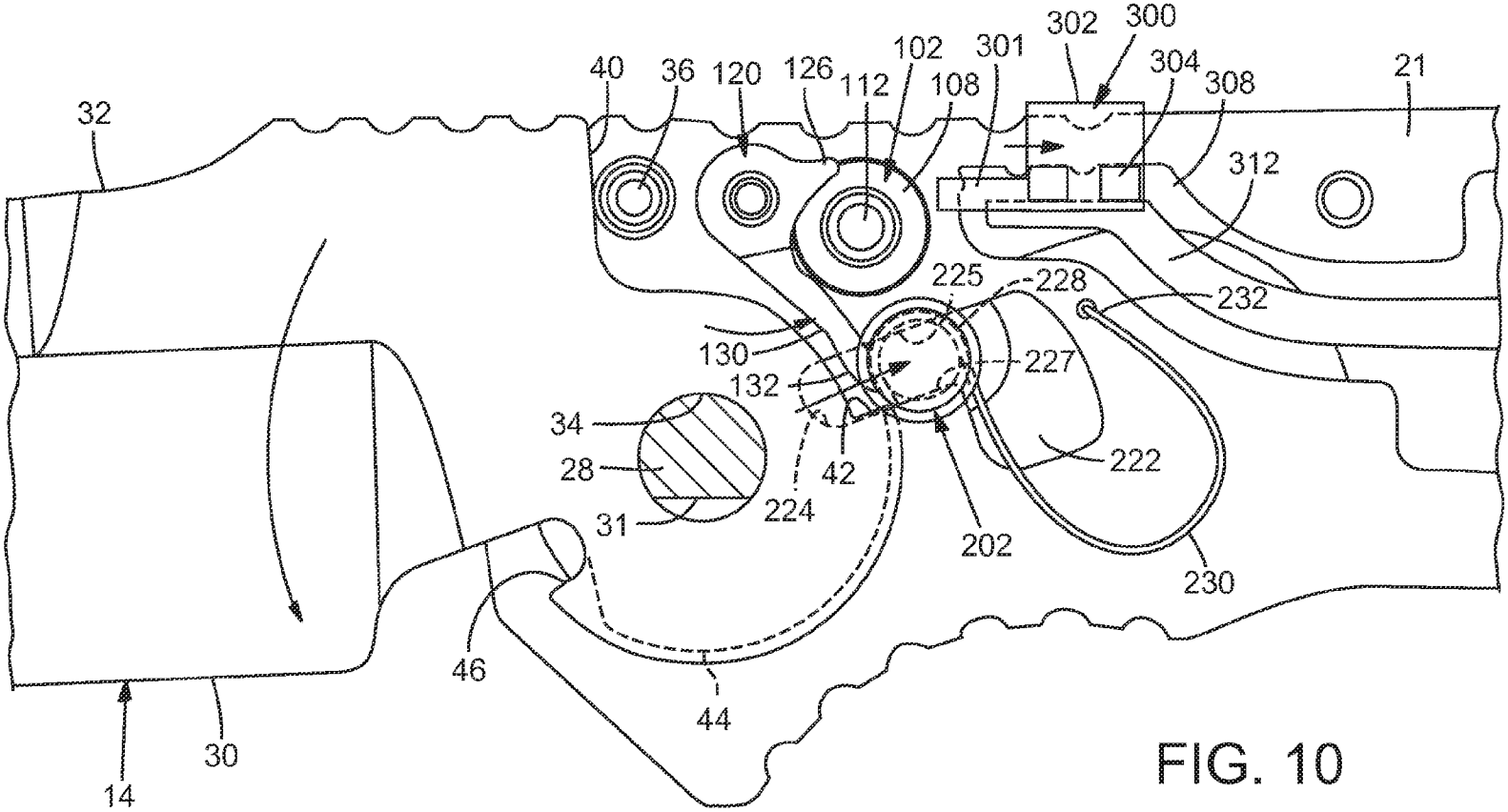
FIG. 10 is a side elevation view of the knife shown in FIG. 9 except an ambidextrous trigger button has been pushed to thereby unlock the blade so that the blade may be folded from the open position toward the closed position.

As seen in FIG. 9, with the blade 14 in the open and locked position, with lock stud 202 engaging locking shoulder 42, the curved tip 132 of lock stud actuator 120 is again positioned immediately adjacent to and forward of lock stud 202 such that the lock stud 202 is again positioned immediately adjacent and nominally spaced apart from the curved tip 132. The actuator button 102 is in its home position and outwardly projecting boss 126 of lock stud actuator 120 is positioned immediately adjacent to the sloped frustoconical portion 108 of button 102. As best illustrated in FIG. 9, the lock stud 202 travels in an angular path in slot 224 relative to the shoulder 42 as the stud moves into the lockup position shown in FIG. 9. The side edges 225 and 227 of slot thus define a travel path for the lock stud 202 that is angularly oriented relative to the plane of the shoulder 42 on the blade on which the lock stud makes contact with the blade. The angle A in FIG. 9 illustrates this angular orientation. The angle A may vary but is preferably around 10 degrees.

To move blade 14 from the open and locked position shown in FIG. 9, either one (or both) of the actuator buttons 102 is depressed to push the button from the home position inwardly toward the center of the handle, against the force of springs 116 and/or 118. This essentially is the same as the operation involved in opening the blade, but the blade will be rotated in the opposite direction (i.e., counterclockwise in FIG. 9, clockwise in FIG. 8). As the button 102 is moved from its home position the sloped side of the frustoconical portion 108 of the button pushes on the chamfered edge 128 of boss 126 of the lock stud actuator 120. As the button is pushed and the frustoconical portion 108 thus pushes on the boss 126, the button causes the lock stud actuator 120 to rotate in the counterclockwise direction (in FIG. 9) about pin 134. As the lock stud actuator so-rotates, the curved tip 132 pushes the lock stud 202 rearwardly in the elongate slot 224 in liner 17, against the opposite urging force of horseshoe shaped spring 230. As the lock stud 202 moves rearwardly, the lock stud moves out of engagement with locking shoulder 42 of blade 14. Once the lock stud clears the locking shoulder 42, the blade may be manually rotated from its open position to its closed position, against the opposite urging force of torsion spring 60. Inwardly directed pressure applied to button 102 may be released as soon as the lock stud 202 clears the locking shoulder 42. As the user rotates the blade from open to dosed, the tip 132 of lever 130 rides in cut out groove 44 in the tang portion 26 of blade 14.

When the blade is fully rotated into the dosed position, lock stud 202 re-engages notch 46 in blade 14 to lock the blade in the dosed position. The torsion spring 60 is re-wound by the rotation of the blade from open to dosed, so the blade is ready to fire open once again. With the blade in the dosed position, the safety bar 302 may then be slid forwardly in the handle to engage the safety mechanism 300.

With returning reference to FIG. 5, it will be appreciated that the actuator buttons 102 may be formed in a variety of different geometric configurations. The actuator button 102 illustrated in FIG. 5 has a cylindrical cross section and as such, the sloped surface 108 that is presented to the chamfered edge 128 is the same around the entire circumference of the button. But the button 102 may have other shapes, such as a rectangular cross section, as long as the button has a sloped surface on that portion of the button that interacts with the chamfered edge 128 on the lock stud actuator 120. Stated another way, the actual shape of the actuator button is not particularly important, apart from that portion of the button that actuates lock stud actuator 120.

From the foregoing description certain structural attributes illustrate a unique functional attribute of the invention. Specifically, in a knife that has a locking pin that extends transverse to the knife handle (as detailed herein), and in which the locking pin must translate in the longitudinal direction of the handle, the ambidextrous actuating mechanism 100 is a structure that allows an actuator that moves in the direction transverse to the blade plane (i.e., actuator button 102 moves in the Z direction, transverse to the X direction) to translate motion to the X direction to thereby cause the locking pin to move in the X direction (to thereby unlock the blade).

Described another way, when a user pushes either of the actuator buttons 102 inwardly (in the Z direction, FIG. 1), this directly causes the curved tip 132 of the lock stud actuator 120 to move in the X direction. Movement of the curved tip 132 in the X direction causes translation of the locking pin in the X direction.

Figure 11B:
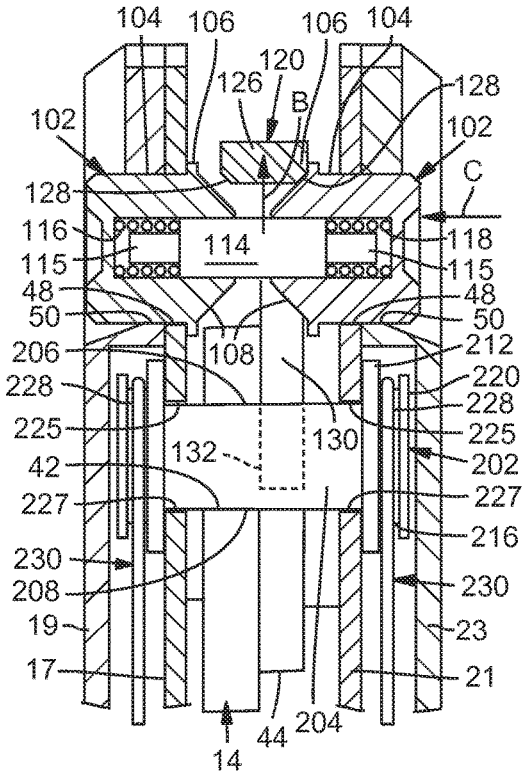
Figure 11C:
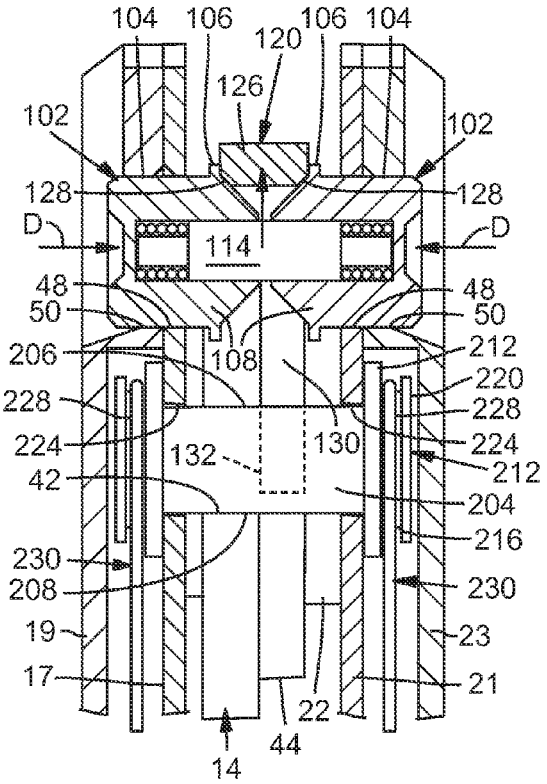

The three cross sectional illustrations of FIGS. 11A, 11B and 11C show the interaction of button 102 as it moved from its home position (FIG. 11A) to the actuation position where the sloped side of the frustoconical portion 108 of the button pushes on the chamfered edge 128 of boss 126 of the lock stud actuator 120 (FIG. 11B, in which the button 102 on the right side of the illustration is pushed inwardly, arrow C). With specific reference to FIGS. 11B and 11C, as one or both of the buttons 102 is pushed and the frustoconical portion 108 thus pushes on the boss 126, the button causes the lock stud actuator 120 to rotate as described above and as illustrated in these figures with arrow B. As the lock stud actuator so-rotates, the curved tip 132 pushes the lock stud 202 in the elongate slots 224 in liners 17 and 21, against the opposite urging force of horseshoe shaped springs 230.

As noted above, the two buttons 102 may be moved independently of one another—either one will cause the blade to fire when only one button is pressed—or may be moved simultaneously. FIG. 11C illustrated both of the actuator buttons 102 being pressed inwardly simultaneously, arrows D.

Figure 12:
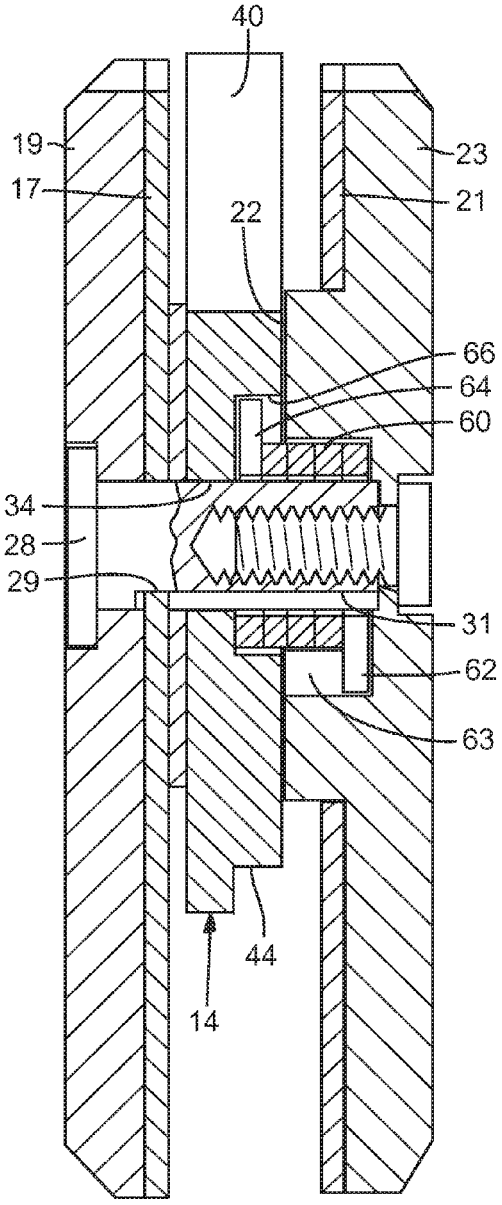
FIG. 12 is a cross sectional view through an assembled knife taken along the line 12-12 of FIG. 9, and with some components removed to illustrate select portions of the blade and drive spring for the automatic opening mechanism.

Turning to FIG. 12, the an assembled knife 10 is shown in cross section with several components removed to illustrate the assembly of the torsion spring 60, with the first leg 62 fixed relative to handle plate 23 and its second leg 64 in groove 66 in blade 14.

Figure 13:
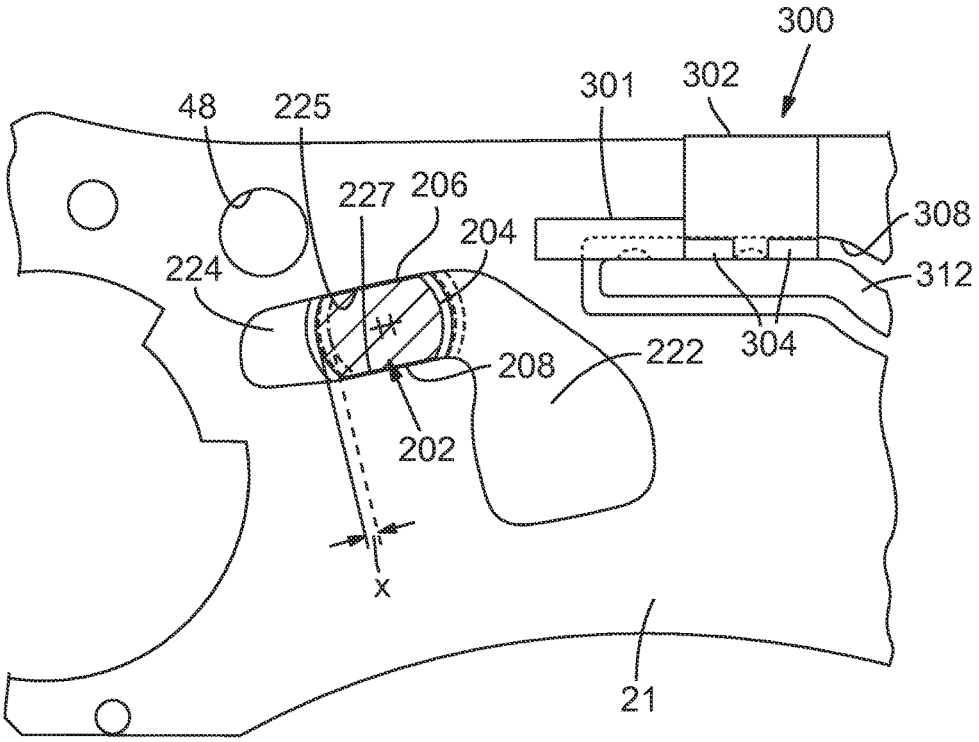
FIG. 13 is a schematic side elevation view of the liner 21 showing the position and of lock stud relative to the liner.

Various attributes of locking mechanism 100 are detailed above both in terms of structure and operation. Nonetheless, the locking mechanism described herein and shown in the drawings is in itself a novel feature of the invention that provides substantial unexpected improvement to numerous aspects of prior locking mechanisms. With reference now to FIG. 13 the lock stud 202 is shown schematically and in cross section as it rides in elongate slot 224 in liner 21. In this view, and also in the view of FIG. 9, it may be seen that the opposite flattened sides 206 and 208 of the lock stud 202 closely abuts the flattened, parallel sides of the slot 224. With respect to FIG. 9, it will further be recognized that when the lock stud 202 is locking the blade in the open position, the position of contact between the lock stud and the locking shoulder 42 is at the forward edge of the lock stud at approximately the point where the flattened side 208 transitions to a rounded frontal surface. As noted, the surface of the locking shoulder 42 is angled slightly relative to the flattened side 208 of the lock stud (i.e., angle A, FIG. 9) when the lock stud is in the lockup position. The upper flattened surface 206 is parallel to the adjacent flattened edge 225 of slot 224. This flat-surface to flat-surface between the lock stud and the liners contributes to a very strong lock up and the device thus provides a very strong and secure engagement.

Unexpectedly, the locking arrangement is notably stronger than the engagement and lock up provided by a cylindrical locking pin (for example, as with the pin described in U.S. Reissue Pat. No. RE 41259). Thus, the force applied to the liners 17 and 21 by the lock stud 202 is spread over a greater surface (i.e., the entire mating surface between the flattened portions of the lock stud across surface 206 and the facing flattened portions of the slots 224, that is, edge 225, and the locking 42 shoulder on the blade).

There are other unexpected advantages to the lock stud 202 as described herein. These include the ability to make the tang portion 26 of the blade stronger than in the past because the locking shoulder 42 can be relatively shorter and thus stronger. The locking shoulder may be shorter because, as shown in FIG. 13, the distance "x" from the full diameter of the locking stud 202 to the leading edge 240 of the locking shoulder 42 (FIG. 9) is less than if a cylindrical stud were utilized. In addition, it has been found that the lock stud 202 configuration leads to increased effective life for the horseshoe shaped springs 203 because there is less travel required in the fore and aft direction to lock and unlock the blade.

Further, there is improved "spine whack" performance demonstrated with the lock stud 202 shown and described herein. Spine whack is the colloquial term that refers to the force that is applied to a knife when, with the blade in the open and locked position, the upper or usually blunt side of the blade is slammed into a solid surface—i.e., whacked against the surface. This so-called spine whack causes significant shock to the knife and its components, especially locking mechanisms. With some locking mechanisms the lock may slip out of the locked position during spine whack and thus cause the blade to close unexpectedly. While this may not cause the lock mechanism to fail, it can be very dangerous. With the flattened configuration described herein where there are flat mating surfaces between the lock stud 202 and the interaction of the lock stud with shoulder 42 and with the parallel sides of slots 224; experimental data have shown that with the knife described herein there is less tendency for the lock stud to slide out of the locking position due to spine whack.

Finally, the lock stud 202 is itself relatively stronger than a cylindrical lock stud because with the same thickness utilized, the lock stud 202 has a greater cross sectional area. It will be appreciated that a lock stud having a square cross sectional area would function equivalently to the lock stud 202 shown in the drawings and described herein.

There are thus at least three attributes of the flattened locking stud 202, as used in the knife described herein, that surprisingly have resulted in far superior performance and strength of the knife:

a) the alignment of the flat surfaces on the locking stud with the flat sides of the elongate groove in which the locking stud reciprocates;

b) the ability to make the tang portion of the blade stronger because with the geometric configuration of the locking stud, the shoulder 42 may extend less distance into the metal of the tang; and c) the ability to fabricate a stronger lock stud.

Furthermore, as best seen in FIG. 9, the location of the actuator mechanism 100 above the lock stud 202 requires that the lock stud and the slots 224 in the liners 17 and 21 be moved to a position below the actuator mechanism. This moves the lock stud to a position close to the longitudinal centerline through the handle. As may be seen in FIG. 9, portions of the lock stud actually overlap with portions of the blade axis pin 28 along an axis extending along the length of the knife. As a result, by moving the lock stud toward the center of the handle there is a greater bulk of handle material located above the lock stud than in prior locking mechanisms, where the lock stud is positioned relatively higher in the handle.

As noted previously, both the actuating mechanism 100 and the locking mechanism 200 described above may be utilized equally in a manual opening knife or a knife that utilizes an auto-assist opening mechanism. There are several structural ways that the mechanism may be used in a manual opener or an auto assist. As a first example, the automatic propulsion system that is utilized in knife 10 described above may simply be removed—that is, the torsion spring 60 may be omitted, and the knife 10 assembled as otherwise indicated. In this case, the knife 10 is fully functional as a manual knife. As a second example, the actuator buttons 102 and associated assemblies, including lock stud actuator 120 may be eliminated in favor of a longer lock stud 202 that extends through the side walls of the handle, similar to the way that the lock described in U.S. Reissue Pat. No. Re 41259 but with the inventive lock stud 202 detailed herein.

Figure 14:
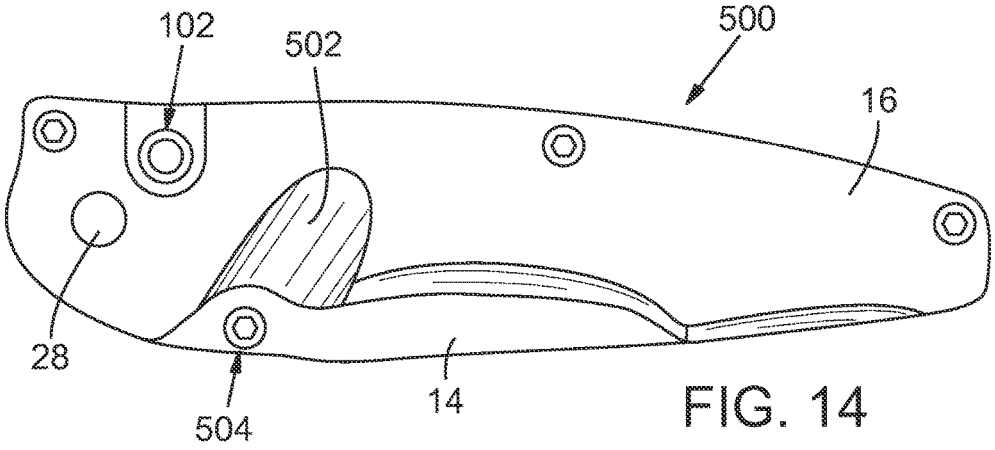
FIGS. 14, 15 and 16 show an alternative embodiment of a knife according to the present invention. Specifically.
Figure 15:
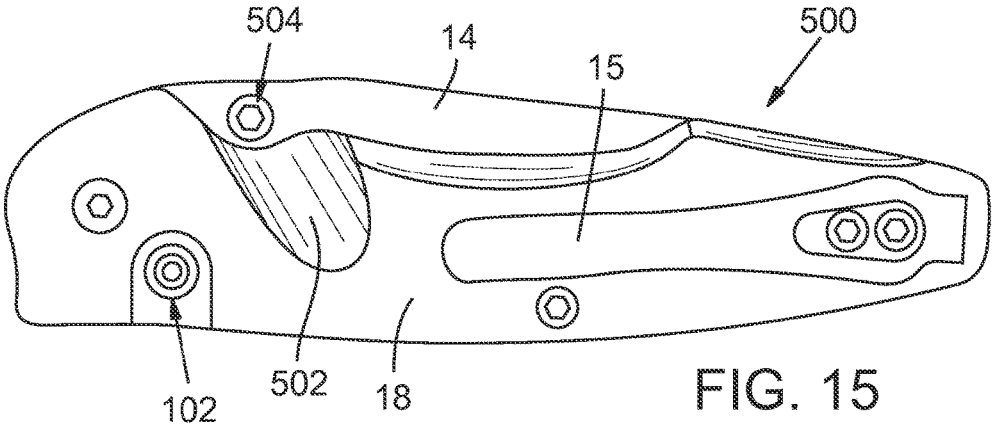

With reference to FIGS. 14 and 15, a knife 500 is illustrated that incorporates an actuator mechanism 100 that is identical to that described above in respect of the embodiment of FIG. 1, and an identical locking mechanism 200, but in which the automatic opening feature is replaced with either an auto assist mechanism or a manual opening structure. In both types of knife, the handles have cut out portions 502 on the outer sides of the outer plates of the handle, located so that the cut out portions define ergonomically shaped channels that allow the user's thumb to easily access the thumb studs 504 that are on both sides of the blade 14. Regardless of whether the knife 500 is a manual knife or an auto assist opening knife, the user can use either their right or left thumb to push the thumb stud on the blade, thus making the opening activation ambidextrous.

Figure 16:
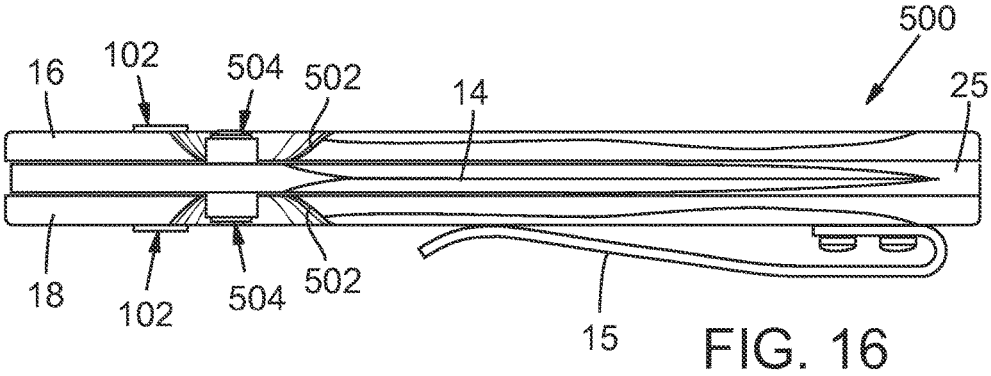

In the assembled knife 500 shown in FIGS. 14, 15 and 16, only the actuator buttons 102 of the actuating mechanism are visible and the locking mechanism 200 is not visible. Nonetheless, when the blade is in the open and locked position, the lock may be released by pressing on the actuator button 102 on either side of the handle, as detailed above. When the button is pushed and the lock stud is thereby moved to the unlocked position, the blade may be rotated to the closed position in the handle.

Turning to the series of illustrations of FIG. 17, an alternative embodiment of a lock stud 202 is shown. In these figures the forward-facing or frontal face 205 of the lock stud has been flattened so that there is a right angle at the intersection of flattened top and bottom surfaces, 206, 208, and the frontal flattened surface 205. The lock stud 202 in FIG. 17 is otherwise the same at that shown elsewhere herein. When the lock stud shown in FIG. 17 is in the lockup position (as shown in FIG. 9, except with the lock stud 202 of FIG. 6), the corner of the lock stud at the intersection of flattened surfaces 205 and 208 makes contact with shoulder 42 on the blade.

Figure 6A:
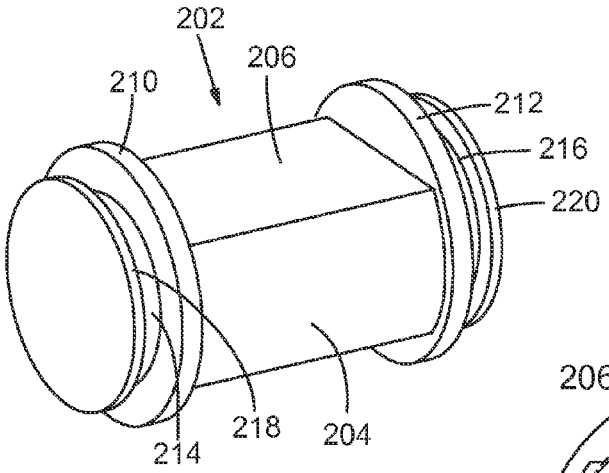
FIGS. 6A, 6B, and 6C are a series of views of the lock stud used in the knife of the present invention, shown in isolation. The lock stud is a component of both the ambidextrous actuation mechanism and the locking mechanism used in the inventive knife.
Figure 6C:
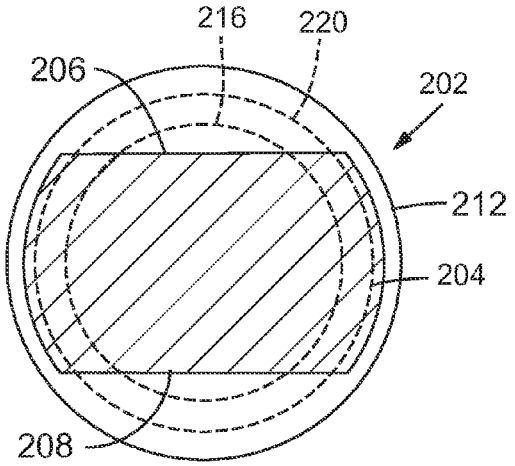
Figure 6B:
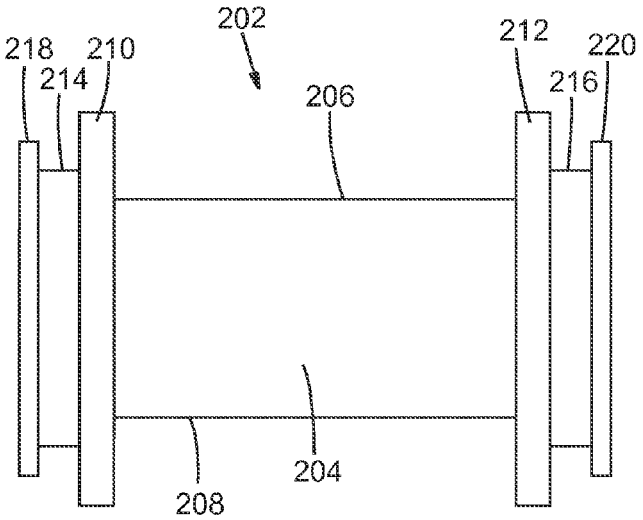
Figure 17A:
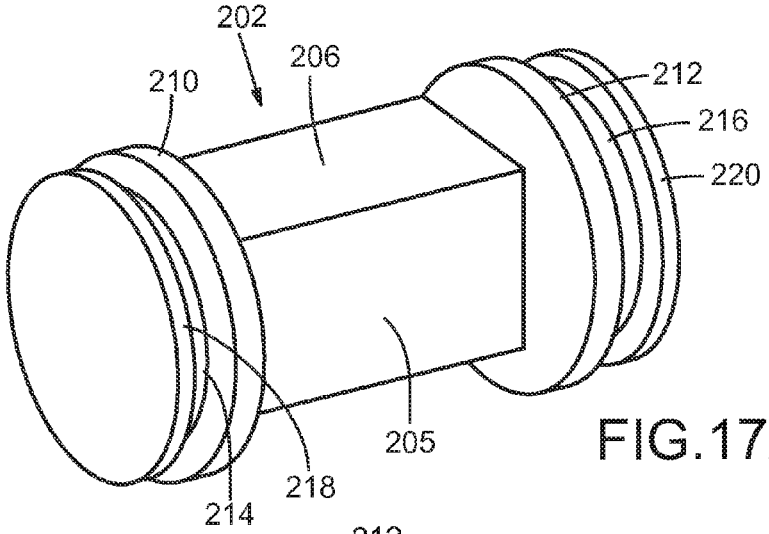
FIGS. 17A, 17B, 17C and 17D are a series of views of an alternative embodiment of a lock stud used in accordance with the present invention.
Figure 17B:
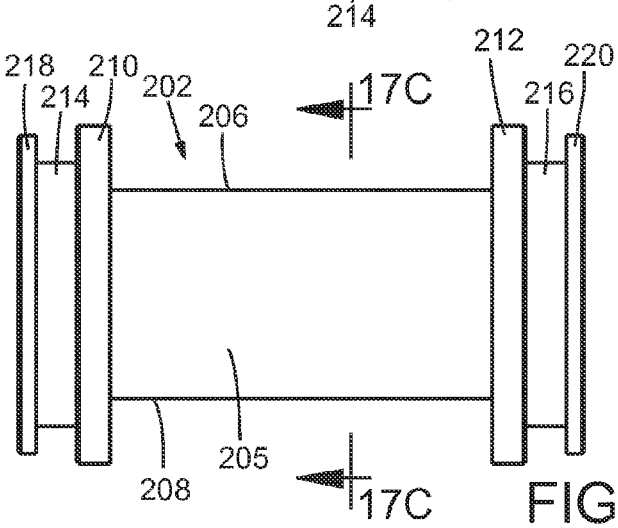
Figure 17C:
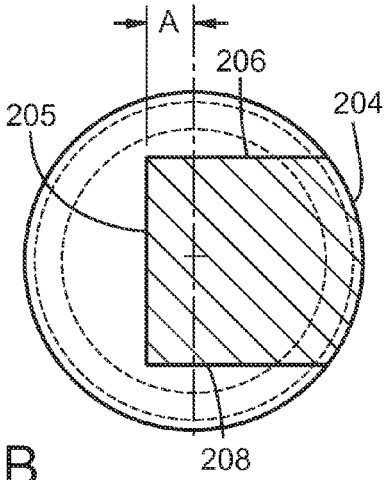
Figure 17D:
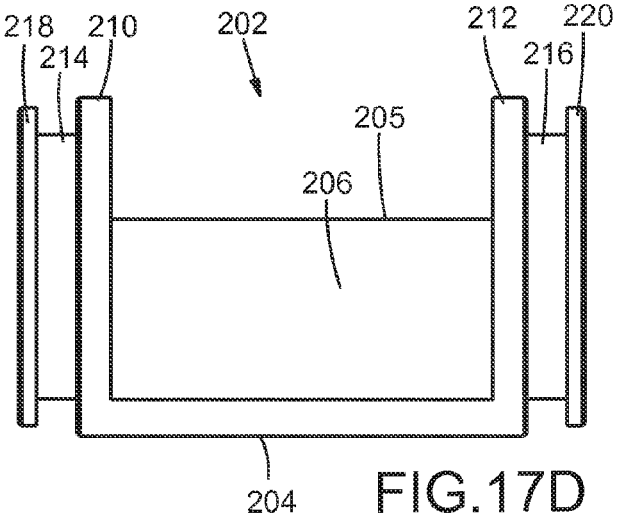

The cross sectional view of FIG. 17C may be compared with the analogous cross sectional view of the embodiment of FIG. 6C to illustrate the amount of material that has been removed from the forward portion of the lock stud in FIG. 17C to define forward flattened surface 205. The distance from axial centerline through the lock stud—the longitudinal axis—to the forward flattened surface 205 is illustrated by the distance A in FIG. 17C. The flattened surface 205 is closer to the axial centerline through the lock stud than the "frontal" surface of the lock stud shown in FIG. 6C. In other words, in FIG. 6C the analogous distance from the axial centerline through the lock stud to the front of the lock stud is far greater than the distance A in FIG. 17. As noted previously, when the lock stud shown in FIG. 17 locks up the blade, the blade (at shoulder 42) makes contact with the lock stud at the intersection of surfaces 205 and 208 on the lock stud. By moving the contact between the lock stud and the blade closer to the axial center of the lock stud, as is done with the embodiment of FIG. 17, the rotational moment applied to the lock stud by the blade when force is applied to the open, locked blade (pushing the blade toward dosed) is less than the case where the contact is further away from the axial center, as would be exemplified with the lock stud shown in FIG. 6. This alternative embodiment thus tends to create a stronger and more stable locking arrangement. This flattened surface 206 is therefore pressed against the flat edge 225 with only a small amount of rotational force applied to the lock stud. In view of the various structural and geometric attributes of the lock stud described and shown herein, it will be appreciated that the cross sectional configuration of the lock stud may take on a variety of forms, for example, the truncated cylinder of FIG. 6A to the three-flat-sided member of FIG. 17A, and also square and rectangular cross sections, to name a few.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. A folding knife, comprising:

a handle defined by first and second spaced apart handle halves defining a blade groove therebetween;

a blade rotationally connected between the handle halves with a pivot shaft extending through a bore in a tang of the blade, the blade movable along a rotational blade path from a closed position to an open position, and from the open position to the closed position, and said blade having a first locking surface on the tang;

a blade locking stud extending transversely with respect to said handle and movable between a first position in which said blade locking stud engages said first locking surface of said tang to lock said blade in the open position, and a second position in which said blade locking stud disengages said first locking surface of said tang to allow said blade to move from the open position to the closed position; and a release button in each of the first and second handle halves, each of said release buttons axially aligned and independently movable transversely of said handle between a first position and a second position, and each of said release buttons is spaced from said blade locking stud and not axially aligned with said blade locking stud, wherein moving either of said release buttons from said first position to said second position simultaneously moves said blade locking stud from its first position to its said second position.

2. The folding knife according to claim 1 further including a spring around the pivot shaft and having a fixed first leg and a second leg engaging the blade and urging the blade at all times from the closed position toward the open position.

3. The folding knife according to claim 2 wherein said tang further includes a second locking surface and wherein when said blade is in the closed position, said blade locking stud in its first position engages said second locking surface to lock said blade in said closed position.

4. The folding knife according to claim 3 wherein moving either of said release buttons from said first position to said second position when said blade is locked in said closed position moves said blade locking stud from its said first position to its said second position to thereby disengage said blade locking stud from said second locking surface.

5. The folding knife according to claim 4 wherein when said blade locking stud is disengaged from said second locking surface, said blade is driven by said spring from said closed position to said open position.

6. The folding knife according to claim 5 wherein when said blade is in said open position, the blade locking stud moves from its second position to its first position.

7. A folding knife, comprising:

a handle defined by first and second spaced apart handle halves defining a blade groove therebetween;

a blade rotationally connected between the handle halves with a pivot shaft extending through a bore in a tang of the blade, the blade movable along a rotational blade path from a closed position to an open position, and from the open position to the closed position, and said blade having a first locking surface on the tang;

a blade locking stud extending transversely with respect to said handle and movable between a first position in which said blade locking stud engages said first locking surface of said tang to lock said blade in the open position, and a second position in which said blade locking stud disengages said first locking surface of said tang to allow said blade to move from the open position to the closed position; and a release button in each of the first and second handle halves, each of said release buttons independently movable transversely of said handle between a first position and a second position, wherein moving either of said release buttons from said first position to said second position simultaneously moves said blade locking stud from its first position to its said second position wherein each of said release buttons includes an actuating surface, and said knife includes a blade locking stud actuator pivotally attached to the handle and having a lever portion operably adjacent said blade locking stud and a locking actuator actuating surface operatively adjacent said actuating surfaces of said release buttons;

wherein, when one of the release buttons is moved from its first position to its second position, said actuating surface of said release button bears on said locking actuator actuating surface, thereby causing said lever portion to move said blade locking stud from its first position to its second position.

8. The folding knife according to claim 7 wherein the actuating surface of said one release button is defined by an angled surface, and said locking actuator actuating surface is a cooperatively angled surface.

9. A folding knife, comprising:

a handle defined by first and second spaced apart handle halves defining a blade groove therebetween;

a blade rotationally connected between the handle halves with a pivot shaft extending through a bore in a tang of the blade, the blade movable along a rotational blade path from a closed position to an open position, and from the open position to the closed position, and said blade having a first locking surface on the tang;

a blade locking stud extending transversely with respect to said handle and movable between a first position in which said blade locking stud engages said first locking surface of said tang to lock said blade in the open position, and a second position in which said blade locking stud disengages said first locking surface of said tang to allow said blade to move from the open position to the closed position;

a release button in each of the first and second handle halves, each of said release buttons axially aligned and independently movable transversely of said handle between a first position and a second position, wherein moving either of said release buttons from said first position to said second position simultaneously moves said blade locking stud from its first position to its said second position; and a blade locking stud actuator pivotally attached to the handle and having a lever portion operably adjacent said blade locking stud;

wherein, when one of the release buttons is moved from its first position to its second position, said blade locking stud actuator causes said blade locking stud to move from its first position to its second position.

10. The folding knife according to claim 9 wherein each of said release buttons includes an actuating surface, and said blade locking stud actuator having a locking actuator actuating surface operatively adjacent said actuating surfaces of said release buttons;

wherein, when one of the release buttons is moved from its first position to its second position, said actuating surface of said release button bears on said locking actuator actuating surface, thereby causing said lever portion to move said blade locking stud from its first position to its second position.

11. The folding knife according to claim 10 wherein the actuating surface of said one release button is defined by an angled surface, and said locking actuator actuating surface is a cooperatively angled surface.

* * * * *